US010560775B2

(12) United States Patent
Pham

(10) Patent No.: US 10,560,775 B2
(45) Date of Patent: Feb. 11, 2020

(54) MULTI-POSITION STRAP ANCHOR

(71) Applicant: MICROSOFT TECHNOLOGY LICENSING, LLC, Redmond, WA (US)

(72) Inventor: Edwin Brad Pham, Cupertino, CA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 0 days.

(21) Appl. No.: 16/004,046

(22) Filed: Jun. 8, 2018

(65) Prior Publication Data

US 2019/0379961 A1 Dec. 12, 2019

(51) Int. Cl.
*A44B 11/00* (2006.01)
*H04R 1/10* (2006.01)

(52) U.S. Cl.
CPC ..... *H04R 1/105* (2013.01); *A44B 11/008* (2013.01); *H04R 1/1008* (2013.01); *H04R 1/1066* (2013.01); *A44D 2203/00* (2013.01); *Y10T 24/32* (2015.01); *Y10T 24/47* (2015.01)

(58) Field of Classification Search
CPC . Y10T 24/32; Y10T 24/3401; Y10T 24/4745; Y10T 24/4755; Y10T 24/4764; Y10T 24/47; Y10T 24/4736; H04R 1/105; H04R 1/1008; H04R 1/1066; A44B 11/008; A44D 2203/00
See application file for complete search history.

(56) References Cited

U.S. PATENT DOCUMENTS

| | | | | |
|---|---|---|---|---|
| 6,067,692 | A | 5/2000 | Chang | |
| 6,108,821 | A | 8/2000 | Malsoute | |
| 6,862,748 | B2 | 3/2005 | Prendergast | |
| 7,898,205 | B2 | 3/2011 | Cheng | |
| 8,358,254 | B2 | 1/2013 | Baudou | |
| 9,241,543 | B1 | 1/2016 | Peng | |
| 9,341,865 | B2 | 5/2016 | Sheldon et al. | |
| 9,743,703 | B2 | 8/2017 | Gotti | |
| 2003/0101547 | A1 | 6/2003 | Chen | |
| 2011/0072564 | A1 | 3/2011 | Krauter | |
| 2012/0222270 | A1 * | 9/2012 | Schultz | A44B 11/22 24/303 |
| 2013/0283508 | A1 | 10/2013 | Durham et al. | |
| 2014/0317890 | A1 | 10/2014 | Koons et al. | |
| 2015/0060507 | A1 | 3/2015 | Levy et al. | |
| 2016/0174647 | A1 | 6/2016 | Benton | |
| 2016/0227868 | A1 | 8/2016 | Mullins et al. | |

FOREIGN PATENT DOCUMENTS

DE 2706695 A1 8/1978

OTHER PUBLICATIONS

"International Search Report and Written Opinion Issued in PCT Application No. PCT/US2019/034771", dated Aug. 23, 2019, 11 Pages.

* cited by examiner

*Primary Examiner* — Robert Sandy
*Assistant Examiner* — Michael S Lee
(74) *Attorney, Agent, or Firm* — Shook, Hardy & Bacon LLP

(57) ABSTRACT

This disclosure describes a multi-position strap anchor that is movable between a first position and a second position. In the first position, the strap anchor may be less accessible to attach to a strap, and in the second position, the strap anchor may be more accessible to attach to a strap.

16 Claims, 7 Drawing Sheets

MULTI-POSITION STRAP ANCHOR

TECHNICAL FIELD

This disclosure relates to an anchor that is attachable to a strap and that is movable between multiple positions.

SUMMARY

Subject matter of this disclosure is defined by the claims below, not this summary. A high-level overview of various aspects of this disclosure is provided here to introduce a selection of concepts that are further described below in the detailed-description section. This summary is not intended to identify key features or essential features of the claimed subject matter, nor is it intended to be used as an aid in isolation to determine the scope of the claimed subject matter. In brief and at a high level, this disclosure describes, among other things, a strap anchor that is selectively movable between various positions.

BRIEF DESCRIPTION OF THE SEVERAL VIEWS OF THE DRAWINGS

This subject matter is described in detail herein with reference to the figures submitted together with this disclosure. The figures are incorporated herein by reference.

DETAILED DESCRIPTION

Figure 1:
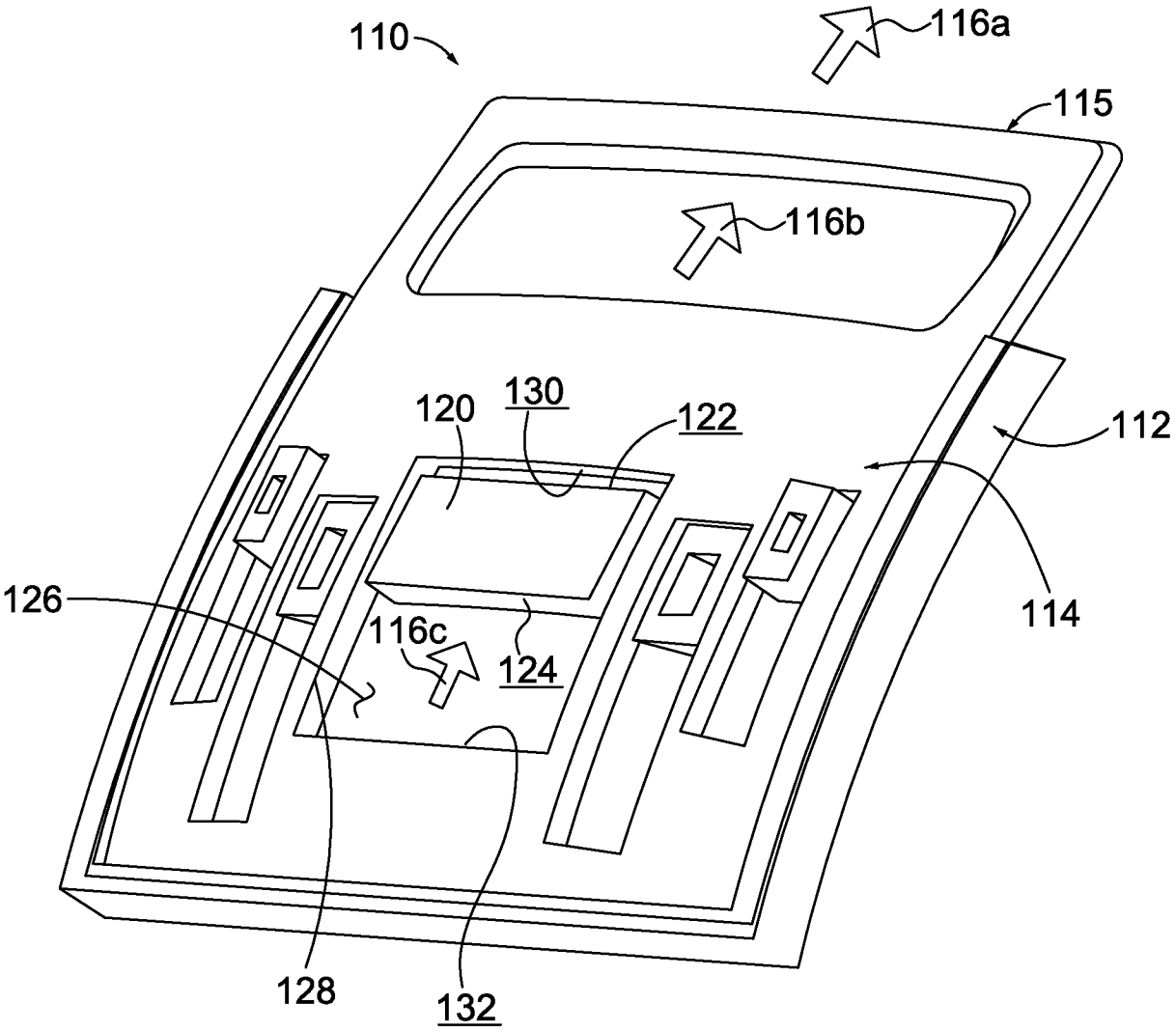
FIG. 1 depicts a multi-position strap anchor in a first configuration in accordance with an aspect of this disclosure.

Subject matter is described throughout this Specification in detail and with specificity in order to meet statutory requirements. But the aspects described throughout this Specification are intended to be illustrative rather than restrictive, and the description itself is not intended necessarily to limit the scope of the claims. Rather, the claimed subject matter might be practiced in other ways to include different elements or combinations of elements that are similar to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

Straps are utilized in various types of articles and for a variety of varied functionality. For example, straps may be used to secure or tie down objects or may be used to connect one part of an article to another part of the article. As such, strap anchors are utilized in various types of articles to provide an attachment point for a strap. For example, strap anchors may be constructed into headwear articles that include straps (e.g., helmets, goggles, glasses, and other eyewear) or other types of garments or accessories with straps (e.g., upper-body protective pads, lower body protective pads, outerwear, gloves, footwear, shin guards, thigh pads, watches, etc.). Headwear articles and garments may utilize straps for various functions, such as to secure one part of the article to another part of the article or to secure the article to a wearer. Strap anchors may also be constructed into other types of articles that include straps, such as bag (e.g., duffel bags, suitcases, purses, luggage, backpacks, shoulder bags, totes, etc.).

In some instances, it may be useful to stow a strap anchor when it is not attached to strap, such as to avoid damaging the strap anchor or to reduce the likelihood that the strap anchor will inadvertently contact, and potentially damage, other articles. Generally, and at a high level, this disclosure describes a multi-position strap anchor that is movable between at least a first position and a second position. For example, the first position might include a retracted or stowed position in which the strap anchor is at least partially hidden or obscured and is less accessible for attachment to a strap, and the second position might include an exposed position in which the strap anchor is more accessible for attachment to a strap. In an aspect of the present disclosure, the multi-position strap anchor includes one or more magnets and a plurality of magnetized surfaces that interact to bias the strap anchor in each position when the strap anchor moves between a first position and a second position.

Figure 2:
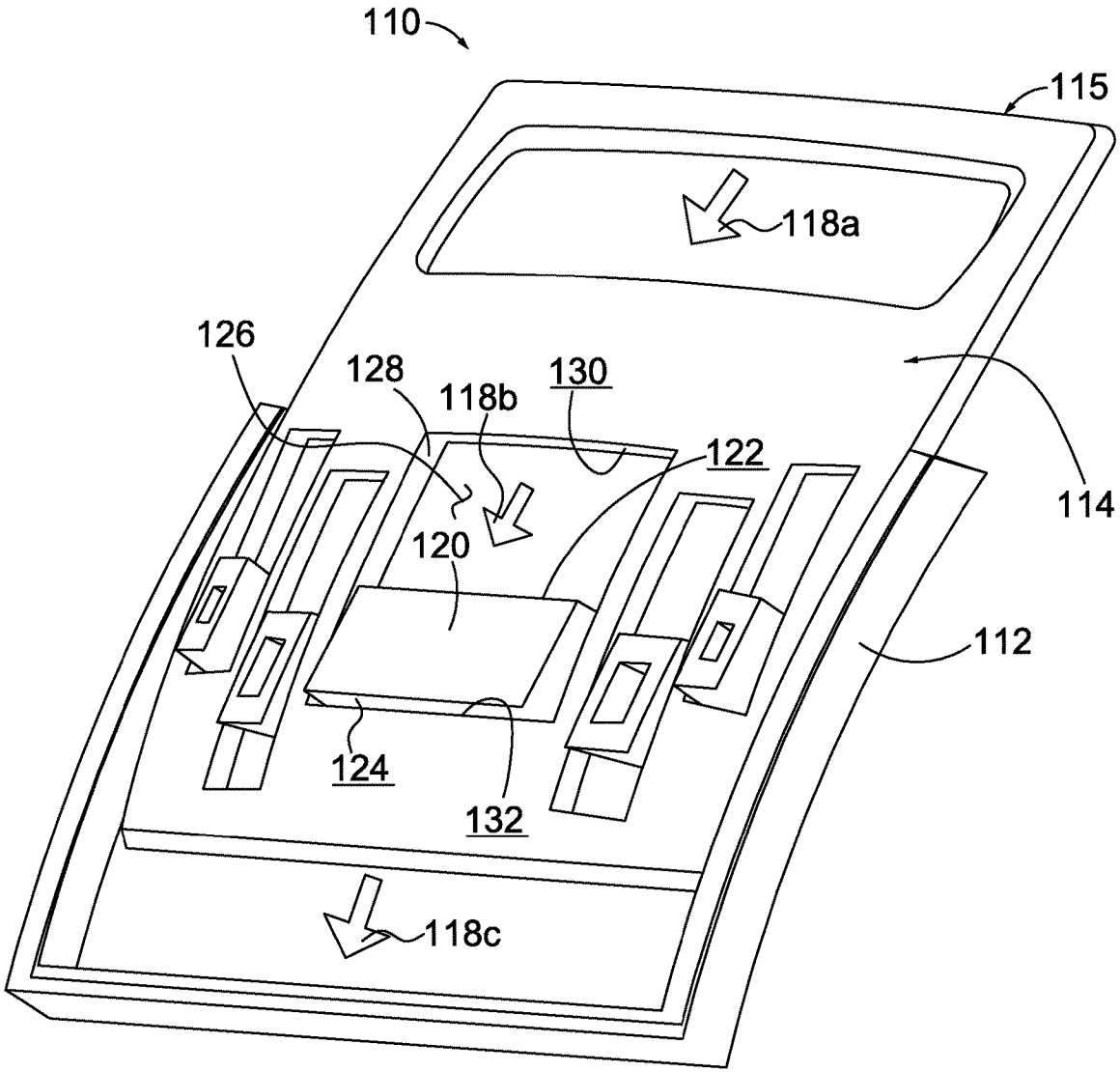
FIG. 2 depicts the multi-position strap anchor of FIG. 1 in a second configuration in accordance with an aspect of this disclosure.

Having generally described some embodiments of the present disclosure, reference is now made to FIGS. 1 and 2 to describe an example of one type of multi-position strap anchor 110 in more detail. The multi-position strap anchor 110 includes a frame 112 and a strap anchor 114 that are slidably coupled to one another, such that the frame 110 and the strap anchor 114 reciprocatingly adjust with respect to one another between a first configuration and a second configuration. In one embodiment of this disclosure "reciprocate" describes an operation of the strap anchor 114 including moving back and forth in a substantially same path between the first configuration and the second configuration. Among other elements, the strap anchor 114 also includes a strap connector 115 for attachment to a strap, and the strap connector 115 illustrated in FIGS. 1 and 2 is a strap ring.

In FIG. 1, the frame 112 and the strap anchor 114 are in a first configuration and the arrows 116*a*, 116*b*, and 116*c* depict a direction in which the strap anchor 114 is slidable (relative to the frame 114) to convert the frame 112 and the strap anchor 114 to a second configuration. In FIG. 2, the multi-position strap anchor 110 is arranged in the second configuration, such as after the strap anchor 114 has been moved in the direction of arrows 116*a*, 116*b*, and 116*c*. FIG. 2 also includes the arrows 118*a*, 118*b*, and 118*c* to depict a direction in which the strap anchor 114 is slidable (relative to the frame 114) to convert the frame 112 and the strap anchor 114 to the first configuration illustrated in FIG. 1.

In a further aspect of the disclosure, the multi-position strap anchor 110 includes one or more magnets and a plurality of magnetized surfaces that interact to help bias the multi-position strap anchor 110 in either the first configuration (e.g., FIG. 1) or the second configuration (e.g., FIG. 2). For example, the multi-position strap anchor 110 includes a magnet 120 attached to the frame 112, and the magnet 120 includes a first magnetic surface 122 and a second magnetic surface 124. The magnet 120 is positioned within a magnet-receiving slot 126 of the strap anchor 114. The strap anchor 114 includes a perimeter edge 128 forming a boundary around the magnet-receiving slot 126, and the perimeter edge 128 includes a first magnetized surface 130 and a second magnetized surface 132. For instance, these portions of the perimeter edge may be constructed of a ferromagnetic material, such as a type of metal.

In accordance with an aspect of the disclosure, in the first configuration depicted in FIG. 1, the first magnetic surface 122 and the first magnetized surface 130 are closer to one another than the second magnetic surface 124 and the second magnetized surface 132. This closer proximity of the first magnetic surface 122 to the first magnetized surface 130 (i.e., relative to the distance between the second magnetic surface 124 and the second magnetized surface 132) attracts the first magnetized surface 130 towards the first magnetic surface 122, and biases the multi-position strap anchor 110 in the first configuration.

In accordance with another aspect of the disclosure, when a force is applied to the anchor strap 114 in the direction of arrows 116*a*, 116*b*, and 116*c* that is stronger than the magnetic attraction between the first magnetic surface 122 and the first magnetized surface 130, then the first magnetized surface 130 disengages away from the first magnetic surface 122. In addition, the frame 112 and the anchor strap 114 may be moved relative to one another as the magnet 120 traverses through the magnet-receiving slot 126, and the second magnetized surface 132 moves towards the second magnetic surface 124. For example, a user might pull on the strap connector 115 in the direction indicated by arrows 116*a*, 116*b*, and 116*c*, until the multi-position strap anchor 110 transitions to the second configuration of FIG. 2. In one aspect, the user might pull onto the strap connector 115 until the second magnetized surface 132 enters the magnetic field emitted by the second magnetic surface 124 and the second magnetized surface 132 is magnetically pulled towards the second magnetic surface 124. In this respect, the user might feel the second magnetized surface 132 be pulled towards the second magnetic surface, which may provide a tactile feedback indicating that the strap anchor 114 snaps into position in the second configuration.

In the second configuration depicted in FIG. 2, the second magnetic surface 124 and the second magnetized surface 132 are closer to one another than the first magnetic surface 122 and the first magnetized surface 130. This closer proximity of the second magnetic surface 124 to the second magnetized surface 132 (i.e., relative to the distance between the first magnetic surface 122 and the first magnetized surface 130) attracts the second magnetized surface 132 towards the second magnetic surface 124, and biases the multi-position strap anchor 110 in the second configuration. Similar to the operation described above (only in reverse), when a force is applied to the anchor strap 114 in the direction indicated by the arrows 118*a*, 118*b*, and 118*c* that is stronger than the magnetic attraction between the second magnetic surface 124 and the second magnetized surface 132, then the second magnetized surface 132 disengages away from the second magnetic surface 124. In addition, the frame 112 and the anchor strap 114 may be moved relative to one another as the magnet 120 traverses through the magnet-receiving slot 126. For example, a user might push on the strap connector 115 in the direction indicated by arrows 118*a*, 118*b*, and 118*c*, until the multi-position strap anchor 110 transitions to the first configuration of FIG. 1. In one aspect, the user might push onto the strap connector 115 until the first magnetized surface 130 enters the magnetic field emitted by the first magnetic surface 122 and the first magnetized surface 130 is magnetically pulled towards the first magnetic surface 122. In this respect, the user might feel the first magnetized surface 130 be pulled towards the first magnetic surface 122, which may provide a tactile feedback indicating that the strap anchor 114 snaps into position in the first configuration.

In the above description of FIGS. 1 and 2, the relative positions of the magnetic surfaces and the magnetized surfaces may be switched. For example, in another embodiment, the perimeter edge 128 includes a first magnetic surface and a second magnetic surface that are spaced apart from one another, and the magnet 120 is replaced with a ferromagnetic block. In another alternative embodiment, a magnet may be attached to the strap anchor and the frame may be constructed to include a magnet-receiving slot. In a further embodiment, a ferromagnetic block may be attached to the strap anchor and the ferromagnetic block may traverse back and forth in a slot of the frame having a first magnetic surface and a second magnetic surface.

Having described some aspects of the multi-position strap anchor 110, some other elements of the frame 112 and the strap anchor 114 will now be described with reference to FIG. 3, which depicts at least some parts of the multi-position strap anchor 110 in an expanded view. In general, the frame 110 provides an enclosure around at least part of the strap anchor 114 and serves as a chassis or foundation for attaching the multi-position strap anchor 110 to other surfaces.

As previously described, the strap anchor 114 includes a strap connector 115, and in addition, the strap anchor 114 includes a carriage portion 117 that operates to help facilitate the motion of the strap anchor 114 relative to the frame 112. For example, the carriage portion 117 includes the magnet-receiving slot 126 and the magnetized surfaces 130 and 132 that help facilitate adjustment between the first configuration and the second configuration. The carriage portion 117 and the strap connector 115 are identified separately for explanatory purposes, and in some embodiments there may be a clear structural distinction between these elements. However, in other embodiments, the distinction between the carriage portion 117 and the strap connector 115 may not be as black and white and the strap anchor may gradually transition from one portion that includes the carriage and another portion that includes the strap connector 115. Furthermore, the strap connector 115 has been described as a strap ring, and the strap ring depicted among the figures includes a through hole 119 through which a portion of a strap may be threaded in order to attach the strap to the strap ring. In other aspects of the disclosure, the strap connector 115 may include other types of strap connectors, such as a cleat around which a strap may be wrapped. In addition, the strap connector may include a buckle or a connecting member of a releasable fastener. For example, the strap connector may include one mating member of a releasable fastener and the strap may include the other mating end of the releasable fastener, such as a snap or a clip.

In one aspect of the disclosure, the frame 112 includes a strap-anchor reciprocation channel 134 defined between two or more side walls that define side boundaries of the channel 134. For example, in FIG. 3, the frame includes a first side rail 136 and a second side rail 138 that form side boundaries of the channel 134. As such, when the strap anchor 114 is positioned in the strap-anchor channel 134 lateral movement by the strap anchor 114 from side-to-side within the channel 134 is restricted by the first side rail 136 and the second side rail 138. Furthermore, the frame 112 includes a frame base wall 140 that connects the first side rail 136 with the second side rail 138 and that forms a bottom or base of the channel 134. Furthermore, the frame base wall 140 includes an anchor-facing surface 142 that faces towards the strap anchor 114 when the strap anchor 114 and the frame 112 are coupled. In this sense, the frame 112 and the strap-anchor reciprocation channel 134 form a pocket in which the strap anchor 114 is at least partially housed and in which the strap anchor 114 can move back and forth between the first configuration and the second configuration.

In a further aspect, one or more additional structures may at least partially enclose, and restrict movement of, the strap anchor 114. These additional structures may be integrally formed with the frame 112 or may be separately formed and then coupled with the frame 112. For example, the first side rail 136 and the second side rail 138 may include lips (not illustrated) that wrap around edges of the strap anchor 114. In another aspect, the frame 112 is coupled to one or more additional walls that are spaced apart from the frame base wall 140 and positioned across from the anchor-facing surface 142, such that the anchor strap 114 is sandwiched between the base wall 140 and the one or more additional walls.

Figure 3:
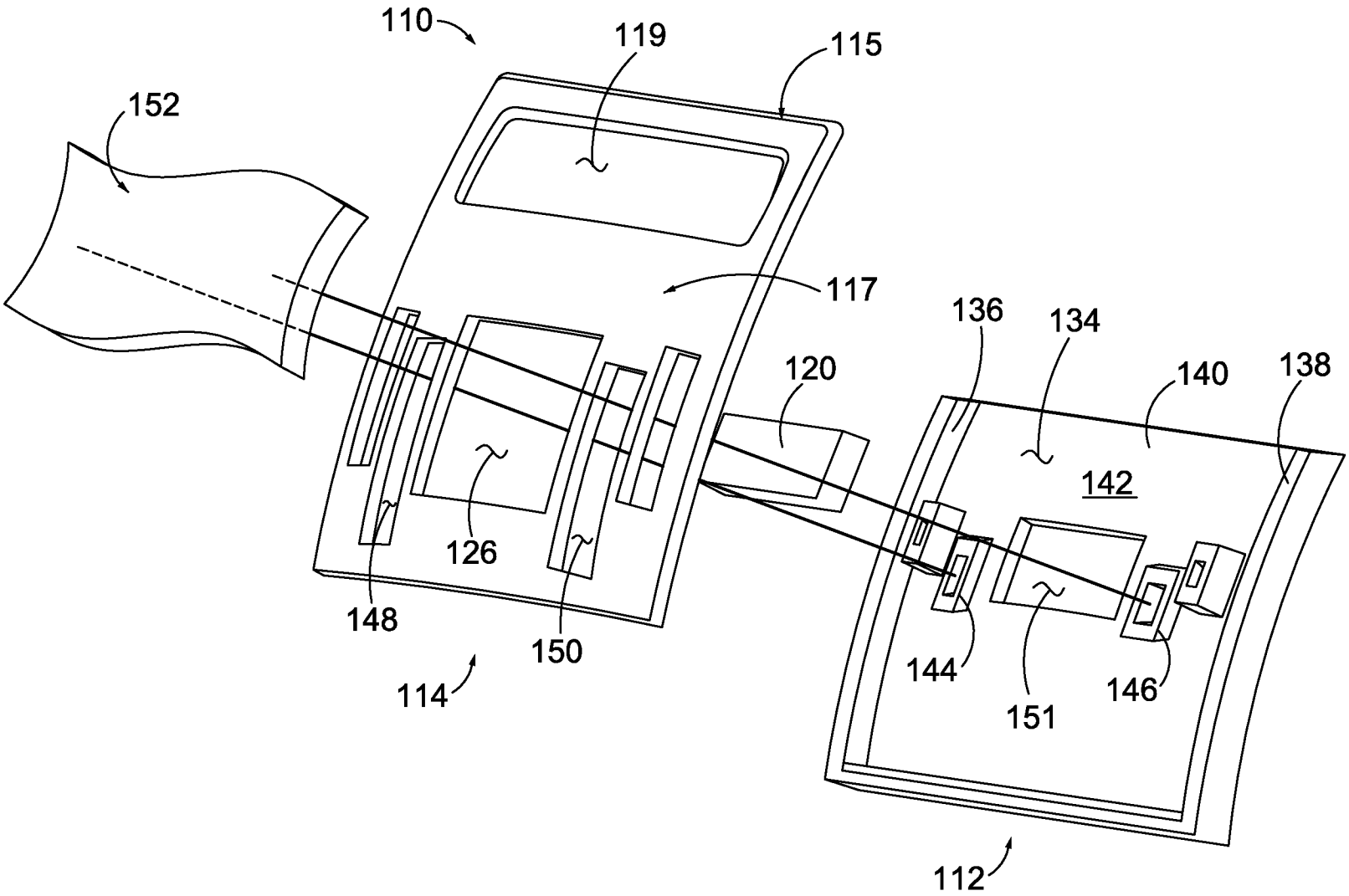
FIG. 3 depicts an expanded view of at least some parts of the multi-position strap anchor of FIGS. 1 and 2 in accordance with an aspect of this disclosure.

In the illustrative example depicted by FIG. 3, the frame base wall 140 includes two attachment posts 144 and 146 protruding from the anchor-facing surface 142. When the multi-position strap anchor 110 is assembled, each attachment post 144 and 146 is positioned through a respective aperture 148 and 150 of the strap anchor 114 and attaches to another frame wall 152. For example, the attachment posts 144 and 146 may be coupled to the frame wall by various types of connections, such as bonding, adhering, sonic welding, etc. As such, the attachment posts 144 and 146 operate to attach the frame walls 140 and 152 to one another, to help align the wall 140 with a particular location on the other wall 152, and to help maintain a spacing between the frame base wall 140 and the other frame wall 152.

The frame wall 152 operate in various manners. For example, when attached to the attachment posts 144 and 146, the frame wall may limit movement of the strap anchor 114 in a direction extending away from the anchor-facing surface 142, and in this sense, the frame wall 152 may operate to help retain the strap anchor 114 in the channel 134. In another aspect, the magnet may be attached to the frame wall 152, instead of to the frame 112. Although the frame wall 152 is depicted a single structure, the frame wall 152 may be a plurality of walls that each separately attaches to a respective portion of the frame 112, such as to the side rails 136 and 138 or to the attachment posts 144 and 146. Furthermore, the frame wall 152 may be a variety of different shapes and sizes, and the depiction in FIG. 3 is merely for illustrative purposes. Moreover, the frame wall 152 and the frame base wall 140 may each be used to affix the multi-position strap anchor 110 onto another article, such as a headwear article or a bag. Alternatively, the frame wall 152 or the frame base wall 140 may be also form another part of a headwear article or a bag.

The frame 114 may include other elements. For example, in one aspect the frame 112 includes a magnet-docking recess 151 that provides a visual indication of where the magnet 120 should be aligned and attached to the anchor-facing surface 142. The magnet 120 may be attached to the frame 112 using various mechanisms, such as a pressure-sensitive adhesive or other adhesive or bonding agent that is cured using other techniques. As indicated above, in an alternative embodiment, the magnet may be affixed to an anchor facing surface of the frame wall 152.

The magnet 120 and the magnet-receiving slot 126 may have other elements. For example, in the illustrative version of FIG. 3, the magnet-receiving slot 126 extends entirely through the thickness of the plate body of the strap anchor 114. That is the strap anchor includes a first surface that faces towards the frame 112 and a second surface facing towards the frame wall 152 and the slot 126 extends entirely through the plate body from the first surface to the second surface. In an alternative embodiment, the slot 126 may only extend partially through the thickness of the plate body.

In a further aspect of the disclosure, the frame 112 includes one or more travel stops 154 and 156, and each travel stop 154 and 156 includes boss, stud, or other type of protrusion extending from the anchor-facing surface 142. Each travel stop 154 and 156 is configured to engage with one or more surfaces of the strap anchor 114 to limit a distance the strap anchor 114 travels when moving within the channel 134 back and forth between the first configuration and the second configuration. For example, the strap anchor 114 includes travel-stop receiving slots 158 and 160, and when the multi-position strap anchor 110 is assembled, each travel stop 154 and 156 is positioned in a respective slot 158 and 160. Although the figures depict the travel stops as being affixed to the frame 112 and the travel-stop receiving slots in the strap anchor 114, in an alternative embodiment, the travel stops may be affixed to, and extend from, a frame-facing surface of the strap anchor 114, and travel-stop receiving slots may be constructed in the frame 112.

Figure 4:
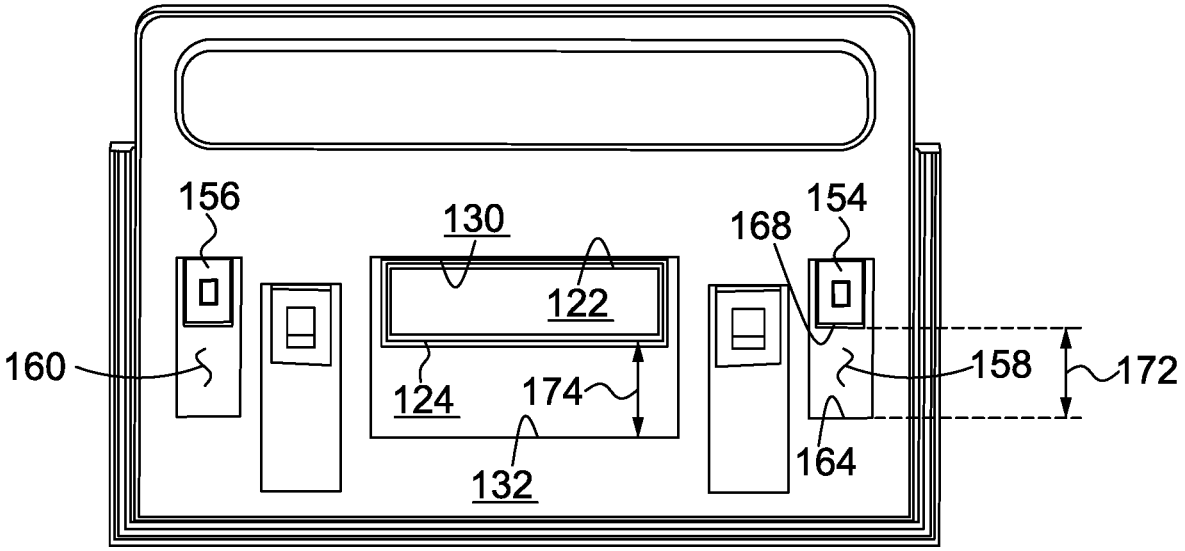
FIG. 4 depicts the multi-position strap anchor in a first configuration in accordance with an aspect of this disclosure.
Figure 5:
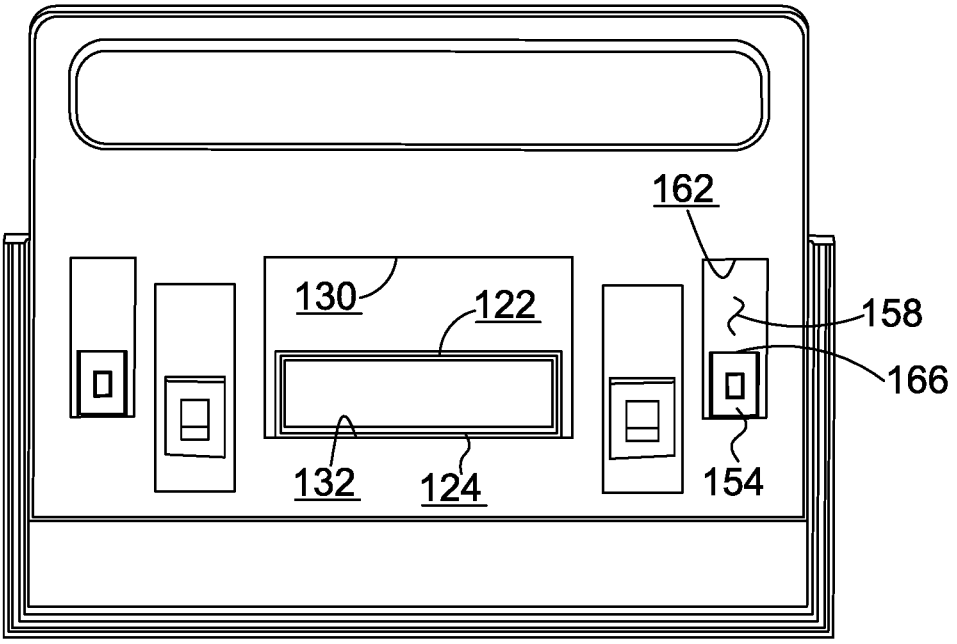
FIG. 5 depicts the multi-position strap anchor in a second configuration in accordance with an aspect of this disclosure.

Referring now to FIGS. 4 and 5, the travel stop 154 and the travel-stop receiving slot 158 will be described in more detail, and a similar structure and description applies to the travel stop 156 and the travel-stop receiving slot 160. FIGS. 4 and 5 illustrate the first and second magnetized surfaces 130 and 132, and the first and second magnetic surfaces 122 and 124. In addition, FIGS. 4 and 5 illustrate a first stop surface 162 and a second stop surface 164 that are spaced apart from one another and that form a perimeter around at least a portion of the travel-stop receiving slot 158. In addition, the travel stop 154 includes a third stop surface 166 that directly contacts the first stop surface 162 in the first configuration (i.e., FIG. 4) and a fourth stop surface 168 that directly contacts the second stop surface 164 in the second configuration (i.e., FIG. 5).

In accordance with an aspect of the present invention, in the first configuration the first stop surface 162 directly contacts the third stop surface 166. In addition, a distance 170 between the first magnetic surface 122 and the first magnetized surface 130 is greater than zero, and the distance is small enough that the first magnetic surface 122 still attracts the first magnetized surface to retain the multi-position anchor strap in the first configuration. In addition, a stop travel distance 172 between the second stop surface 164 and the fourth stop surface 168 is shorter than a second distance 174 between the second magnetized surface 132 and the second magnetic surface 124. As a result, when the multi-position strap anchor moves between the first configuration and the second configuration, the stop surfaces function to control and limit the travel distance of the strap anchor 114 relative to the frame 112.

The anchor strap 114 and the frame 112 may be constructed of various materials. For example, the anchor strap 114 may be include a metal plate (or other ferromagnetic material) that is stamped, die cut, laser cut, or otherwise formed to include the magnet-receiving slot, through hole 119, and other elements 148 and 150. In another embodiment, the frame 112 comprises a molded or cast polymer. In one aspect of the present invention, the combination of the metal-plate construction of the strap anchor layered between the frame walls, in addition to the position of the magnet within the magnet-receiving slot contributes to a relative low profile of the multi-position anchor. That is, the metal construction allows for a relatively slim strap anchor, and the nesting relationship of the magnet in the magnet-receiving slot allows for the magnet and the strap anchor to be co-planar, which may reduce the overall thickness of the multi-position strap anchor.

Figure 6B:
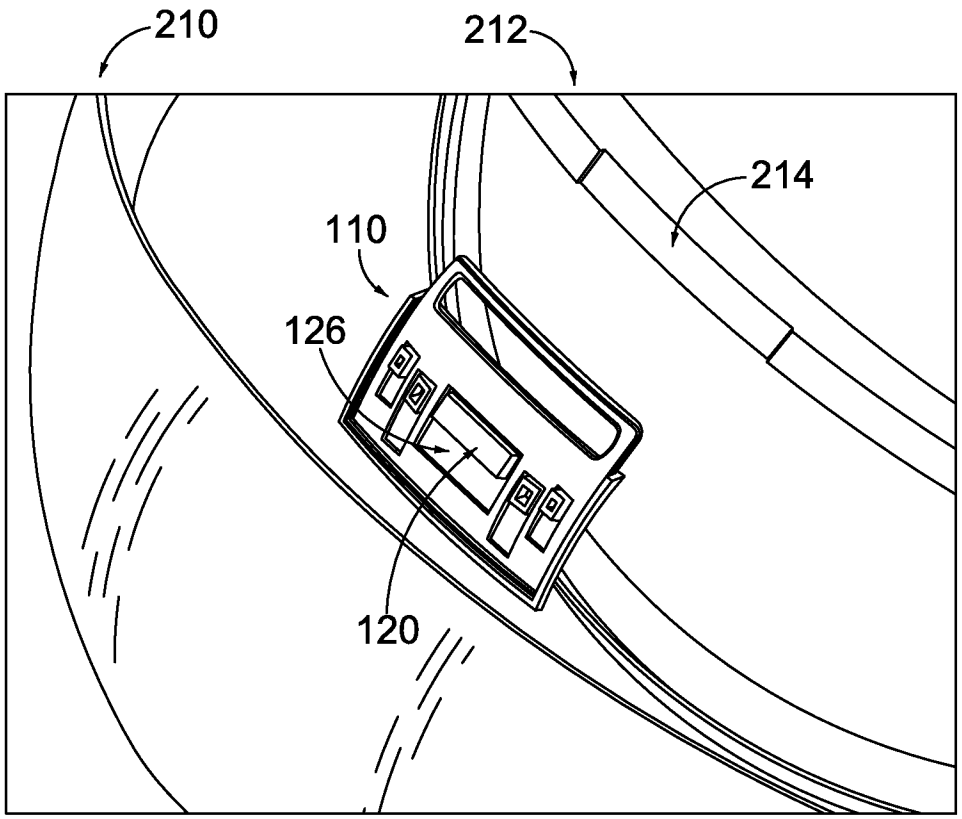
FIG. 6B depicts the multi-position strap anchor and headwear article of FIG. 6A in an expanded view.
Figure 6A:
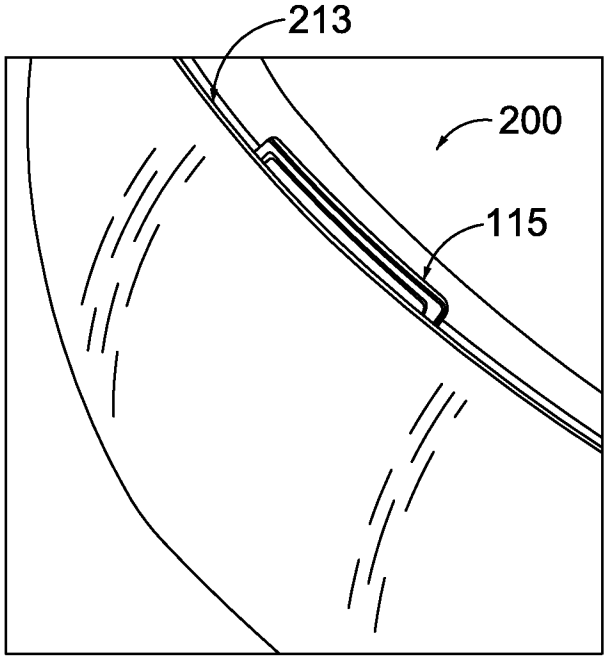
FIG. 6A depicts the multi-position strap anchor in a first configuration and attached to a headwear article.

As explained above, the multi-position strap anchor may be incorporated into a variety of different types of articles, and the frame walls 114 and 152 might be used to attach the multi-position strap anchor to an article or might comprise a portion of an article. For example, the frame walls 114 and 152 may include portions of a helmet or other headwear; portions of a watch or other jewelry or wearable accessory; portions of a bag or other type of carrying case; or portions of an electronic device, such as a camera, gaming controller, or other computing device. Referring now to FIGS. 6A and 6B, a portion of a headwear article 200 is depicted for illustrative purposes, and a multi-position strap anchor in a first configuration (e.g., FIGS. 1 and 4) is coupled to the headwear article 200. The headwear article might include various types, such as a protective helmet, eyewear, or a portion of a virtual-reality headset or an augmented-reality headset.

The headwear article 200 includes a first shell 210 and a second shell 212 that meet at an interface 213, and the multi-position strap anchor 110 is secured at the interface 213 and between the first and second shells. The first shell 210 may include various elements, and in one aspect, the first shell 210 is relatively hard and rigid and functions as a structural frame for the headwear article 200. For example, the first shell 210 may be constructed of a relatively hard plastic. The second shell 210 may also include various elements, and in one aspect, the second shell 212 comprises a padding layer. For example, the second shell 212 may be constructed of a foam or fluid bladder (e.g., air bladder or gel bladder). The headwear article 200 may include various additional layers and elements coupled between the first and second shells 210 and 212, depending on one or more functions and purposes of the headwear article 200.

In an aspect of the disclosure, the first shell 210 comprises the frame wall 152 and the frame 112 attaches directly to the first shell component 210. Furthermore, the second shell 212 includes a cutout 214, and the multi-position strap anchor 110 is positioned in the cutout when coupled to the headwear article 200. As such, the cutout 214 provides an opening through which the strap anchor 114 can move when reciprocating between the first configuration and the second configuration. As shown in FIG. 6B, the multi-position strap anchor 110 is in the first configuration, based on the relative positions of the strap anchor 114 to the frame 112 and of the magnet 120 within the magnet-receiving slot 126. As previously described, the first configuration may include a retracted or stowed position in which the strap anchor is at least partially hidden or obscured and is less accessible for attachment to a strap, and for illustrative purposes, FIG. 6A depicts the multi-position strap anchor as partially hidden or obscured by the elements of the headwear article.

Figure 7A:
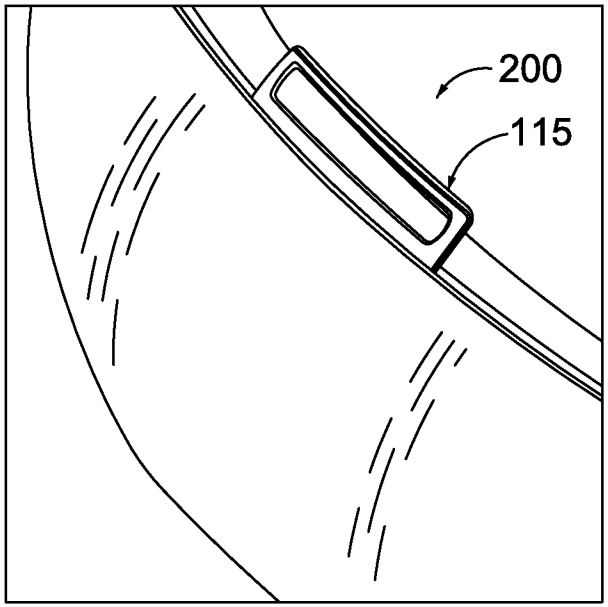
FIG. 7A depicts the multi-position strap anchor in a second configuration and attached to a headwear article.
Figure 7B:
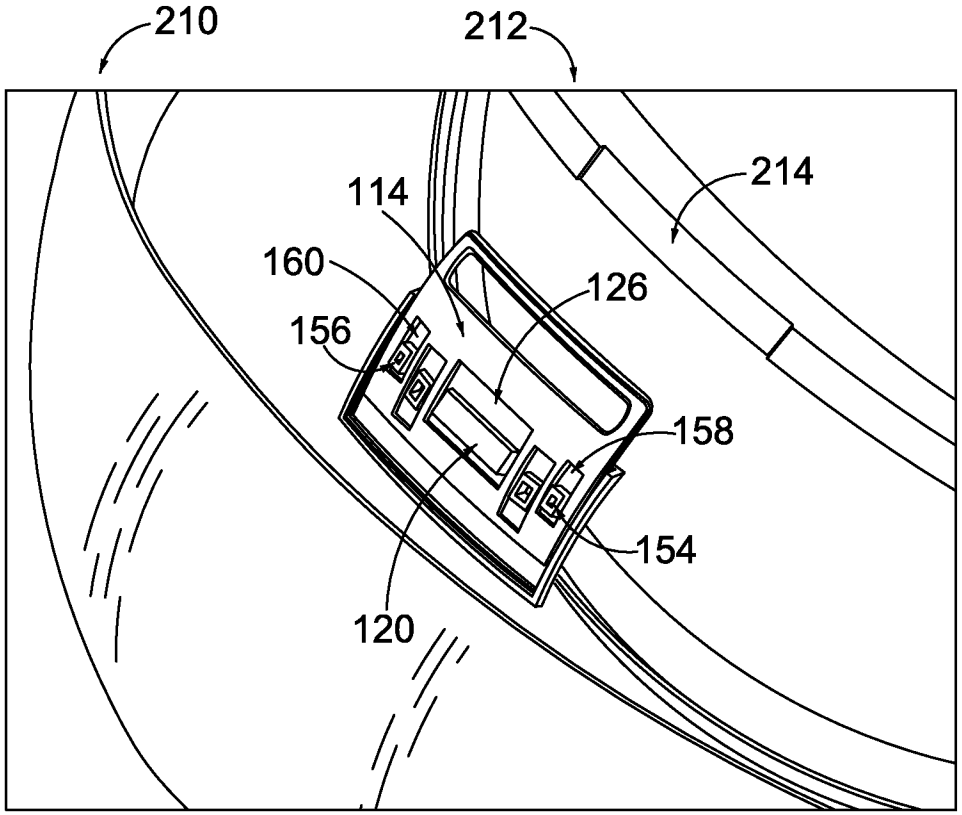
FIG. 7B depicts the multi-position strap anchor and headwear article of FIG. 7A in an expanded view.

Referring now to FIGS. 7A and 7B a portion of the headwear article 200 is depicted, and the multi-position strap anchor is in a second configuration (e.g., FIGS. 2 and 5). For example, the strap connector 115 may have been pulled to slide the strap anchor 114 through the cutout 212 until each of the travel stops 154 and 156 contacts the respective end of a travel-stop receiving slot 158 and 160. As previously described, the magnetic action between the magnet 120 and the magnetized surfaces of the strap anchor 114 may provide a tactile feedback indicating to a user when the strap anchor is snapped into position.

As shown in FIG. 7B, the multi-position strap anchor 110 is in the second configuration, based on the relative positions of the strap anchor 114 to the frame 112 and of the magnet 120 within the magnet-receiving slot 126. As previously described, the second configuration may include an exposed position in which the strap anchor is more accessible for attachment to a strap, and for illustrative purposes, FIG. 7A depicts more of the strap connector 115 exposed for easier engagement with strap.

Figure 8:
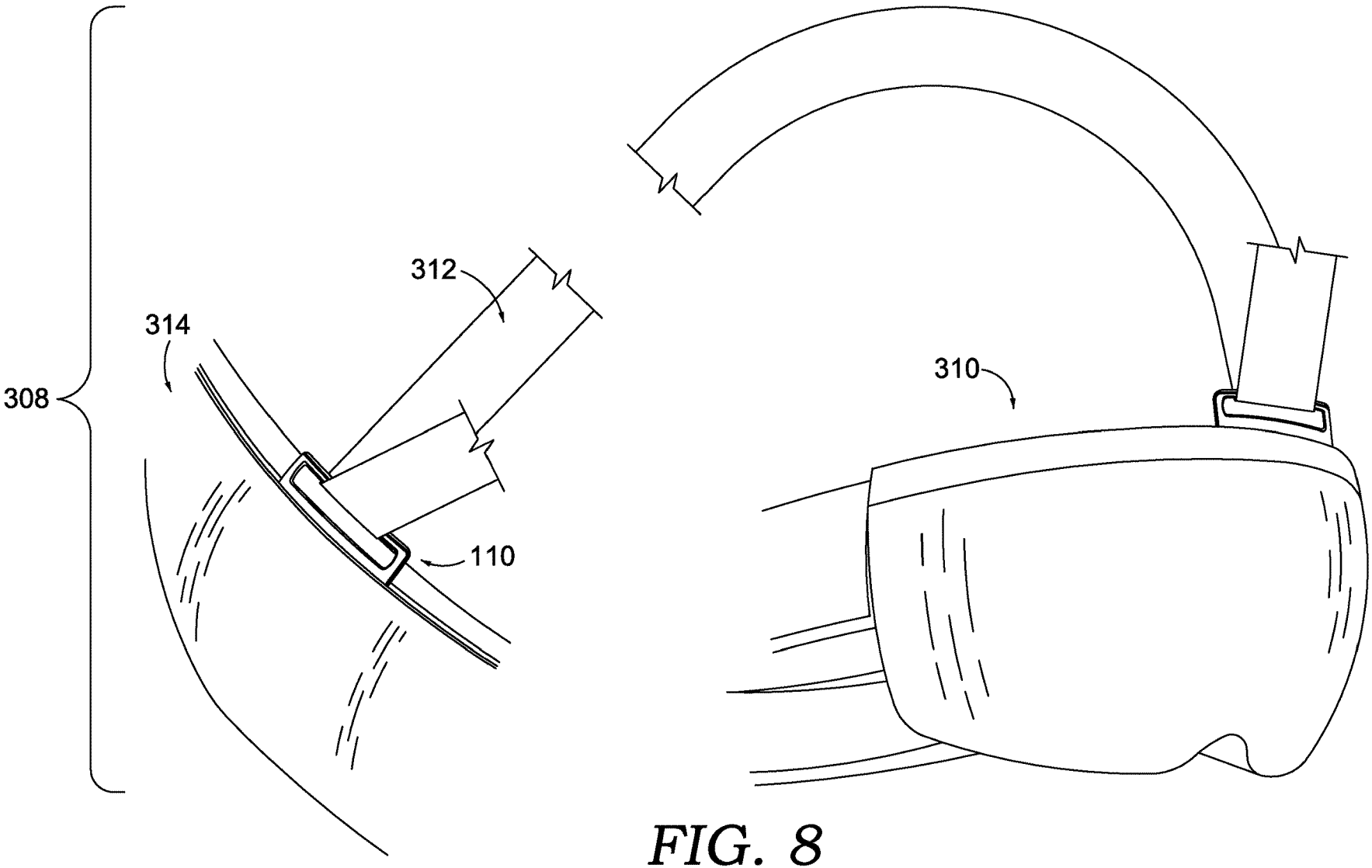
FIG. 8 depicts the multi-position strap anchor attached to an augmented- or virtual-reality headset.

A further aspect of the present disclosure includes a virtual-reality headset 308 that includes a strap and a multi-position strap anchor. For example, referring to FIG. 8, some elements of a virtual-reality headset are illustrated, including a lens assembly 310, a strap 312, and a portion of a shell assembly 314. The strap 312 connects the portion of the shell assembly 314 to the lens assembly 310 (e.g., functions to provide virtual and/or augmented reality experience) and may operate to help secure the virtual-reality headset 308 to a wearer. Furthermore, the shell assembly 314 includes a multi-position strap anchor 110 that connects to the strap 312. The multi-position strap anchor 110 may be selectively adjusted between the first and second configuration. For example, when the virtual-reality headset 308 is being shipped or stored, the multi-position strap anchor 110 may be moved into the first configuration. Alternatively, when the virtual-reality headset 308 is being worn, the multi-position strap anchor 110 may be moved to the second configuration (as shown in FIG. 8) to attach to the strap 312 and to function to connect the lens assembly 310 to the shell assembly 314 and to secure the virtual-reality headset onto a wearer's head.

Having described various aspects of the subject matter, additional disclosure is provided below that is consistent with the claims recited at the end of this Specification when originally filed. In describing this additional subject matter, reference may be made to the previously described figures.

One aspect of the present disclosure includes a multi-position strap anchor for attachment to a strap. The multi-position strap anchor includes a frame and a strap anchor that are slidably coupled to one another, such that the frame and the strap anchor reciprocatingly adjust with respect to one another between a first configuration and a second configuration. The multi-position strap anchor also includes a magnet coupled to either the frame or the strap anchor and including a first magnetic surface and a second magnetic surface. For example, FIGS. 1-3 illustrate the magnet 120 as being attached to the frame 112, and the detailed description also describes that the magnet 120 could be attached to the strap anchor 114. In addition, the multi-position strap anchor includes a magnet-receiving slot that is constructed into the strap anchor if the magnet is coupled to the frame and that is constructed into the frame if the magnet is coupled to the strap anchor. The magnet-receiving slot includes a first magnetized surface and a second magnetized surface, and the magnet is positioned in the magnet-receiving slot and between the first magnetized surface and the second magnetized surface. Furthermore, in the first configuration the strap anchor is in a first position relative to the frame; the first magnetic surface is positioned a first distance apart from the first magnetized surface; the second magnetic surface is positioned a second distance apart from the second magnetized surface; and the first distance is shorter than the second distance. In the second configuration the strap anchor is in a second position relative to the frame; the first magnetic surface is positioned a third distance apart from the first magnetized surface; the second magnetic surface is positioned a fourth distance apart from the second magnetized surface; and the third distance is longer than the fourth distance.

Another aspect of the present disclosure includes a multi-position strap anchor for attachment to a strap, the multi-position strap anchor including a frame having a strap-anchor reciprocation channel. The multi-position strap anchor also a strap anchor movably retained in the strap-anchor reciprocation channel, such that the strap anchor reciprocatingly adjusts with respect to the frame between a first configuration and a second configuration. Further, a magnet is coupled to the frame and includes a first magnetic surface and a second magnetic surface. The strap anchor includes an anchor carriage coupled to a strap connector, and the anchor carriage includes a magnet-receiving slot. In addition, the anchor carriage includes a first magnetized surface and a second magnetized surface that form a perimeter at least partially around the magnet-receiving slot. The magnet is positioned in the magnet-receiving slot and between the first magnetized surface and the second magnetized surface. The multi-position strap anchor includes the first configuration in which the first magnetic surface is positioned a first distance apart from the first magnetized surface, the second magnetic surface is positioned a second distance apart from the second magnetized surface, and the first distance is shorter than the second distance. Moreover, the multi-position strap anchor includes the second configuration in which the first magnetic surface is positioned a third distance apart from the first magnetized surface, the second magnetic surface is positioned a fourth distance apart from the second magnetized surface, and the third distance is longer than the fourth distance.

In another aspect, the present disclosure includes a headset having a first shell component, a second shell component, and a multi-position strap anchor coupled between the first shell component and the second shell component. The multi-position strap anchor includes a frame attached to the first shell component, and the frame and the first shell component at least partially enclose a strap-anchor reciprocation channel. A strap anchor is retained in the strap-anchor reciprocation channel and between the frame and the first shell component. A magnet is coupled to the frame, to the first shell component, or to both the frame and the first shell component, and the magnet including a first magnetic surface and a second magnetic surface. The strap anchor includes a first magnetized surface and a second magnetized surface that form a perimeter at least partially around a magnet-receiving slot, and the magnet is positioned in the magnet-receiving slot and between the first magnetized surface and the second magnetized surface. The headset also includes a strap that attaches to the multi-position strap anchor.

From the foregoing, it will be seen that this subject matter is one well adapted to attain the ends and objects hereinabove set forth together with other advantages which are inherent to the structure. It will be understood that certain features and subcombinations are of utility and may be employed without reference to other features and subcombinations. This is contemplated by and is within the scope of the claims. Since many possible alternatives might be made without departing from the scope thereof, it is to be understood that all matter herein set forth or shown in the accompanying drawings is to be interpreted as illustrative and not in a limiting sense.

The invention claimed is:

1. A multi-position strap anchor for attachment to a strap, the multi-position strap anchor comprising:

a frame and a strap anchor that are slidably coupled to one another, such that the frame and the strap anchor reciprocatingly adjust with respect to one another between a first configuration and a second configuration;

a magnet coupled to either the frame or the strap anchor and including a first magnetic surface and a second magnetic surface; and a magnet-receiving slot that is constructed into the strap anchor, if the magnet is coupled to the frame, and that is constructed into the frame, if the magnet is coupled to the strap anchor, wherein the magnet-receiving slot includes a first magnetized surface and a second magnetized surface, wherein the magnet is positioned in the magnet-receiving slot and between the first magnetized surface and the second magnetized surface, wherein the multi-position strap anchor includes the first configuration in which the strap anchor is in a first position relative to the frame, the first magnetic surface is positioned a first distance apart from the first magnetized surface, the second magnetic surface is positioned a second distance apart from the second magnetized surface, and the first distance is shorter than the second distance, and wherein the multi-position strap anchor includes the second configuration in which the strap anchor is in a second position relative to the frame, the first magnetic surface is positioned a third distance apart from the first magnetized surface, the second magnetic surface is positioned a fourth distance apart from the second magnetized surface, and the third distance is longer than the fourth distance.

2. The multi-position strap anchor of claim 1, wherein the frame includes a first surface and the strap anchor includes a second surface, which faces towards the first surface;

wherein one of the first surface and the second surface includes a travel stop protruding therefrom; and wherein the other of the first surface and the second surface includes a travel-stop receiving slot in which the travel stop is positioned and through which the travel stop traverses when the frame and the strap anchor recpricatingly adjust between the first configuration and the second configuration.

3. The multi-position strap of claim 2, wherein the travel stop protrudes from the first surface of the frame and the travel-stop receiving slot is constructed in the second surface of the strap anchor.

4. The multi-position strap of claim 2, wherein the travel stop protrudes from the second surface of the strap anchor and the travel-stop receiving slot is constructed in the first surface of the frame.

5. The multi-position strap anchor of claim 1, wherein the magnet is coupled to the frame and the magnet-receiving slot is constructed into the strap anchor.

6. The multi-position strap anchor of claim 1, wherein the magnet is coupled to the strap anchor and the magnet-receiving slot is constructed into the frame.

7. The multi-position strap anchor of claim 1, wherein the strap anchor includes a strap ring.

8. The multi-position strap anchor of claim 1, wherein the strap connector includes a mating component of a releasable fastener.

9. A multi-position strap anchor for attachment to a strap, the multi-position strap anchor comprising:

a frame comprising a strap-anchor reciprocation channel;

a strap anchor movably retained in the strap-anchor reciprocation channel, such that the strap anchor reciprocatingly adjusts with respect to the frame between a first configuration and a second configuration;

a magnet coupled to the frame and including a first magnetic surface and a second magnetic surface;

the strap anchor including an anchor carriage coupled to a strap connector, the anchor carriage including a magnet-receiving slot, wherein the anchor carriage includes a first magnetized surface and a second magnetized surface that form a perimeter at least partially around the magnet-receiving slot, wherein the magnet is positioned in the magnet-receiving slot and between the first magnetized surface and the second magnetized surface, wherein the multi-position strap anchor includes the first configuration in which the first magnetic surface is positioned a first distance apart from the first magnetized surface, the second magnetic surface is positioned a second distance apart from the second magnetized surface, and the first distance is shorter than the second distance, and wherein the multi-position strap anchor includes the second configuration in which the first magnetic surface is positioned a third distance apart from the first magnetized surface, the second magnetic surface is positioned a fourth distance apart from the second magnetized surface, and the third distance is longer than the fourth distance.

10. The multi-position strap anchor of claim 9, wherein the frame includes a first frame wall having first anchor-facing surface and a second frame wall having a second anchor-facing surface, the first anchor facing surface and the second anchor facing surface being spaced apart from one another, and wherein the magnet is coupled to the first anchor-facing surface.

11. The multi-position strap anchor of claim 10, wherein at least one of the first frame wall and the second frame wall include at least a portion of a headwear article.

12. The multi-position strap anchor of claim 10, wherein the strap anchor includes a plate body having a first portion comprising the anchor carriage and a second portion comprising the strap connector, the plate body including a first surface facing towards the first anchor-facing surface and a second surface facing towards the second anchor-facing surface; and wherein the magnet-receiving slot extends entirely through the plate body from the first surface to the second surface.

13. The multi-position strap anchor of claim 12, wherein the second portion of the plate body includes a strap-receiving through hole extending entirely through the plate body from the first surface to the second surface.

14. The multi-position strap anchor of claim 10, wherein the frame includes a travel stop protruding towards the strap-anchor body, and wherein the strap-anchor body includes a travel-stop receiving slot in which the travel stop is positioned.

15. The anchor mechanism of claim 14, wherein the strap-anchor body includes a first stop surface and a second stop surface that are spaced apart from one another and that form a perimeter around at least a portion of the travel-stop receiving slot, wherein the travel stop includes a third stop surface that directly contacts the first stop surface in the first configuration and a fourth stop surface that directly contacts the second stop surface in the second configuration.

16. The anchor mechanism of claim 15, wherein in the first configuration the first distance is greater than zero and a travel distance between the third stop surface and the fourth stop surface is shorter than the second distance between the second magnetized surface and the second magnetic surface.

* * * * *